US008274445B2

(12) United States Patent
Collinson et al.

(10) Patent No.: US 8,274,445 B2
(45) Date of Patent: Sep. 25, 2012

(54) PLANAR ARRAY ANTENNA HAVING RADOME OVER PROTRUDING ANTENNA ELEMENTS

(75) Inventors: Donald L. Collinson, Lafayette, NY (US); Blake A. Carnahan, II, Manlius, NY (US); Carl Coates, Lansing, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 401 days.

(21) Appl. No.: 12/480,450

(22) Filed: Jun. 8, 2009

(65) Prior Publication Data

US 2010/0309089 A1 Dec. 9, 2010

(51) Int. Cl.
*H01Q 1/42* (2006.01)
*H01Q 21/00* (2006.01)

(52) U.S. Cl. ..... 343/872; 343/826; 343/893

(58) Field of Classification Search ..... 343/872, 343/826, 893
See application file for complete search history.

(56) References Cited

U.S. PATENT DOCUMENTS 4,749,997 A * 6/1988 Canonico ..... 343/705
4,914,449 A 4/1990 Fukuzawa et al.
5,392,053 A 2/1995 Hirata et al.
5,650,788 A 7/1997 Jha
5,880,694 A 3/1999 Wang et al.
5,905,466 A 5/1999 Jha
5,907,304 A 5/1999 Wilson et al.
6,114,997 A 9/2000 Lee et al.
6,317,094 B1 11/2001 Wu et al.
6,624,787 B2 9/2003 Puzella et al.
7,265,719 B1 9/2007 Moosbruger et al.
7,289,082 B2 * 10/2007 Condon et al. ..... 343/893
7,348,932 B1 3/2008 Puzella et al.
2003/0020655 A1 * 1/2003 McKinzie et al. ..... 343/700 MS
2005/0035915 A1 2/2005 Livingston et al.
2007/0030205 A1 2/2007 Farrell et al.
2010/0315311 A1 * 12/2010 Touchard ..... 343/872

* cited by examiner

*Primary Examiner* — Douglas W Owens
*Assistant Examiner* — Jennifer F Hu
(74) *Attorney, Agent, or Firm* — Howard IP Law Group, PC

(57) ABSTRACT

A subarray of a planar array antenna has a ground plane having a rear face and a front face, radiating elements, each of the radiating elements protruding forward of the front face and physically mounted to the ground plane; circuit elements electrically coupled to the radiating elements, and physically mounted to the ground plane and positioned rearward of the rear face of the ground plane; and a dielectric radome supported on the ground plane defining a continuous surface sealed to the ground plane. The continuous surface includes a forward wall positioned forward of each of the radiating elements to form an environmental seal around the radiating elements. The radome has an intermediate wall intermediate at least one pair of adjacent ones of the antenna elements.

24 Claims, 14 Drawing Sheets

PLANAR ARRAY ANTENNA HAVING RADOME OVER PROTRUDING ANTENNA ELEMENTS

FIELD OF INVENTION

The present invention relates to phased array antennas and radomes for phased array antennas.

BACKGROUND

Planar phased array antennas, for use in systems including, by way of example, communications systems and radar systems, include ground planes and radiating elements. Some designs of radiating elements protrude forward of a ground plane. Non-limiting examples of such radiating elements include stacked microstrip patches, stripline and microstrip dipoles, Vivaldi's, Helices and Monopoles. In mobile or transportable planar array antennas, radiating elements may be arranged in tiles that may be connected by hinges, to permit folding for transport. Referring to FIG. 1, a partially cutaway view of an exemplary prior art planar array 100 is shown. Array 100 has two sections 104, 106, hingedly attached to one another at hinge 108. In section 104, radome 110 is shown partially cut away. Radome 110 is supported on standoffs (not shown) above tile 120 having radiating elements 122. Elements 122 shown in FIG. 1 are parasitically excited patch antennas, having radiating elements 124 on dielectric supports 126. Elements 122 are on ground plane 130. Radome 110 is also supported on ground plane 130. Radome 110 may be, by way of example, a single-piece A-sandwich, which is a layer of foam having layers of rigid dielectric material on both sides of the foam.

The A-sandwich radome 110 is both heavy and thick, adding volume and weight to the array. The standoffs 112, 114, further add weight to the array. In order to obtain access from the front to any tile 120, the entire radome 110 must be removed. The removal involves the use of personnel or equipment sufficient to handle the relatively large and heavy radome, and exposes numerous tiles to the environment. An alternative prior art radar array shown in FIG. 2 is a folding radar array 150 with a multi-section radome 160. Multi-section radome 160 is made up of individual sections 162, which may correspond to individual subarray tiles. The regular periodic discontinuities between sections 162 may result in grating lobes, which can degrade the radiation pattern performance of the array compared to the pattern performance in the absence of a radome.

A-sandwich radomes of panels of random size, shape and orientation are also known in the prior art. The use of random sizes tends to avoid periodic discontinuities, thereby reducing grating lobes. However, such panels are generally large, heavy and difficult to remove. In addition, the differing sizes and shapes of panels means that numerous sizes and shapes must be made available to replace damaged panels.

SUMMARY

In one embodiment of the invention, a subarray of a planar array antenna has a ground plane having a rear face and a front face; radiating elements, each of the radiating elements protruding forward of the front face and physically mounted to the ground plane; circuit elements electrically coupled to the radiating elements, and physically mounted to the ground plane and positioned rearward of the rear face of the ground plane; and a dielectric radome supported on the ground plane defining a continuous surface sealed to the ground plane, the continuous surface including a forward wall positioned forward of each of the radiating elements to form an environmental seal surrounding the radiating elements, the radome further having an intermediate wall intermediate at least one pair of adjacent ones of the antenna elements.

In an embodiment, a planar array antenna includes adjacent subarrays. Each of the subarrays has a ground plane having a rear face and a front face; antenna elements, each antenna element extending forward of the front face of the ground plane and physically mounted to the ground plane; circuit elements electrically coupled to the antenna elements and physically mounted to the ground plane and positioned rearward of the rear face of the ground plane; and a dielectric radome supported on the ground plane. Each radome has a continuous surface sealed to the ground plane and positioned forward of each of the antenna elements to form an environmental seal surrounding the antenna elements. Each radome further has a wall positioned intermediate at least one pair of adjacent ones of the antenna elements. Each radome further has a radially extending lip adjacent the ground plane and overlapping the lip of the radome of the adjacent subarray.

In another embodiment, a radome for a subarray of a planar array antenna, which subarray has radiating elements protruding forward of a ground plane, includes a continuous, environmentally-protective, rigid dielectric thin member, having: a central section having alternating grooves and pockets shaped to receive the radiating elements and separate adjacent pairs of radiating elements; and a continuous lip, circumscribing the central section, the lip lying in a plane for sealing to the ground plane.

In another embodiment, a method of manufacturing a planar array antenna includes providing subarray components, each of which has: a ground plane having a rear face and a front face; radiating elements, each of the radiating elements protruding forward of the front face of the ground plane and physically mounted to the ground plane; transmit-receive devices electrically coupled to the radiating elements, and physically mounted to the ground plane and positioned rearward of the rear face of the ground plane. The method further includes positioning, so as to receive each of the radiating elements, a continuous, waterproof, rigid dielectric radome having: a central section having alternating grooves and pockets shaped to receive the radiating elements and separate adjacent pairs of radiating elements; and a continuous lip, circumscribing the central section, the lip lying in a plane for sealing to the ground plane. The method further includes seatingly attaching to the ground plane the lip of the radome to define a watertight seal.

DETAILED DESCRIPTION

It is to be understood that the figures and descriptions of the present invention have been simplified to illustrate elements that are relevant for a clear understanding of the present invention, while eliminating, for the purpose of clarity, many other elements found in typical phased antenna arrays. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

A challenge recognized by the inventors is of providing a phased array having subarrays, with antenna elements extending forward of the ground plane, which array is lightweight and permits access to the subarrays from the front with minimal use of personnel time and equipment.

Figure 1:
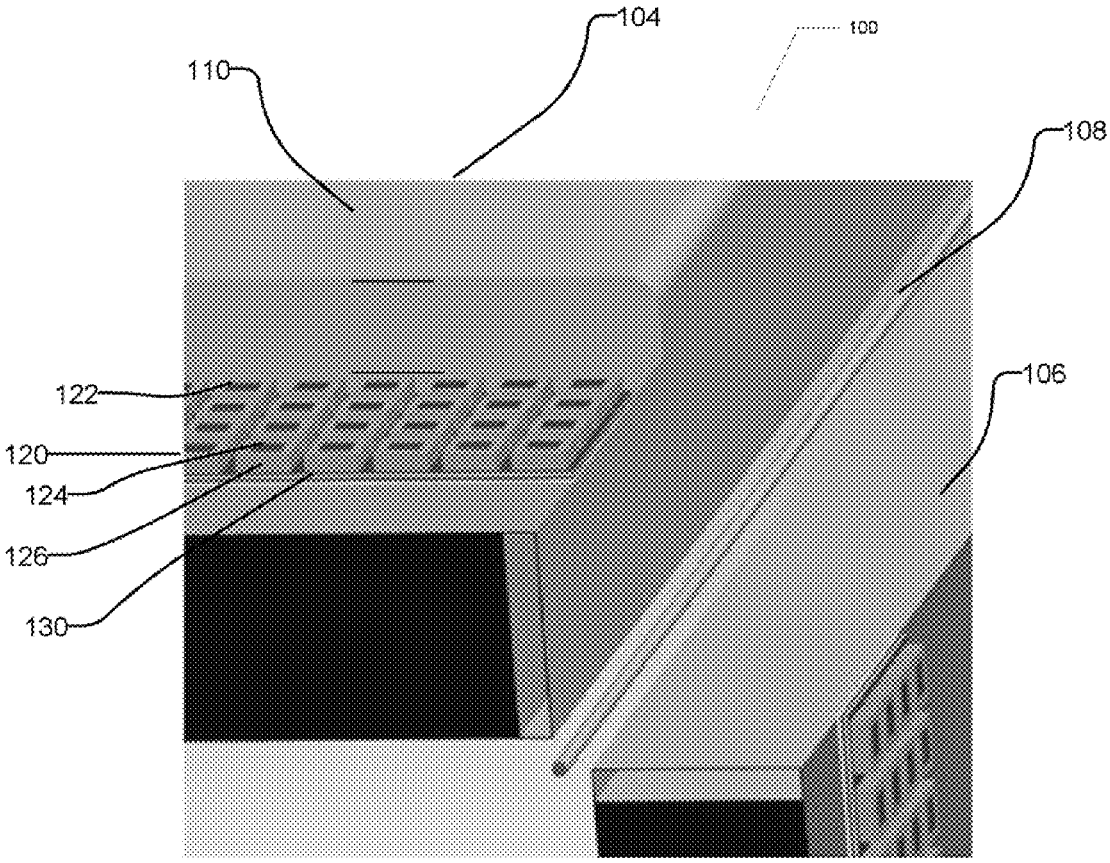
Fig. 1 PRIOR ART
FIG. 1 is a somewhat schematic perspective view of a prior art radome on a prior art planar array antenna.
Figure 2:
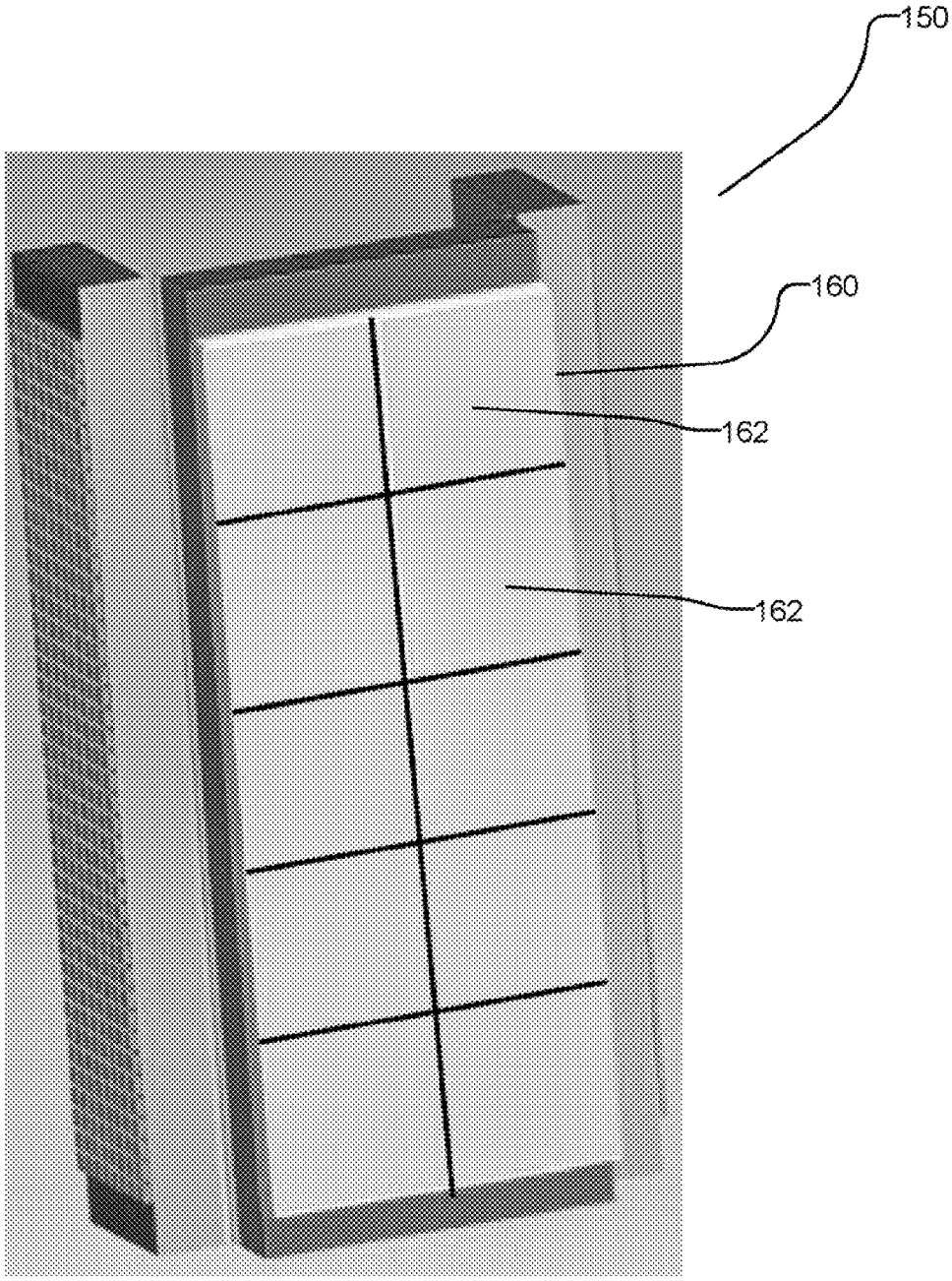
Fig. 2 PRIOR ART
FIG. 2 is a somewhat schematic perspective view of an alternative prior art radome on a prior art planar array antenna.
Figure 3:
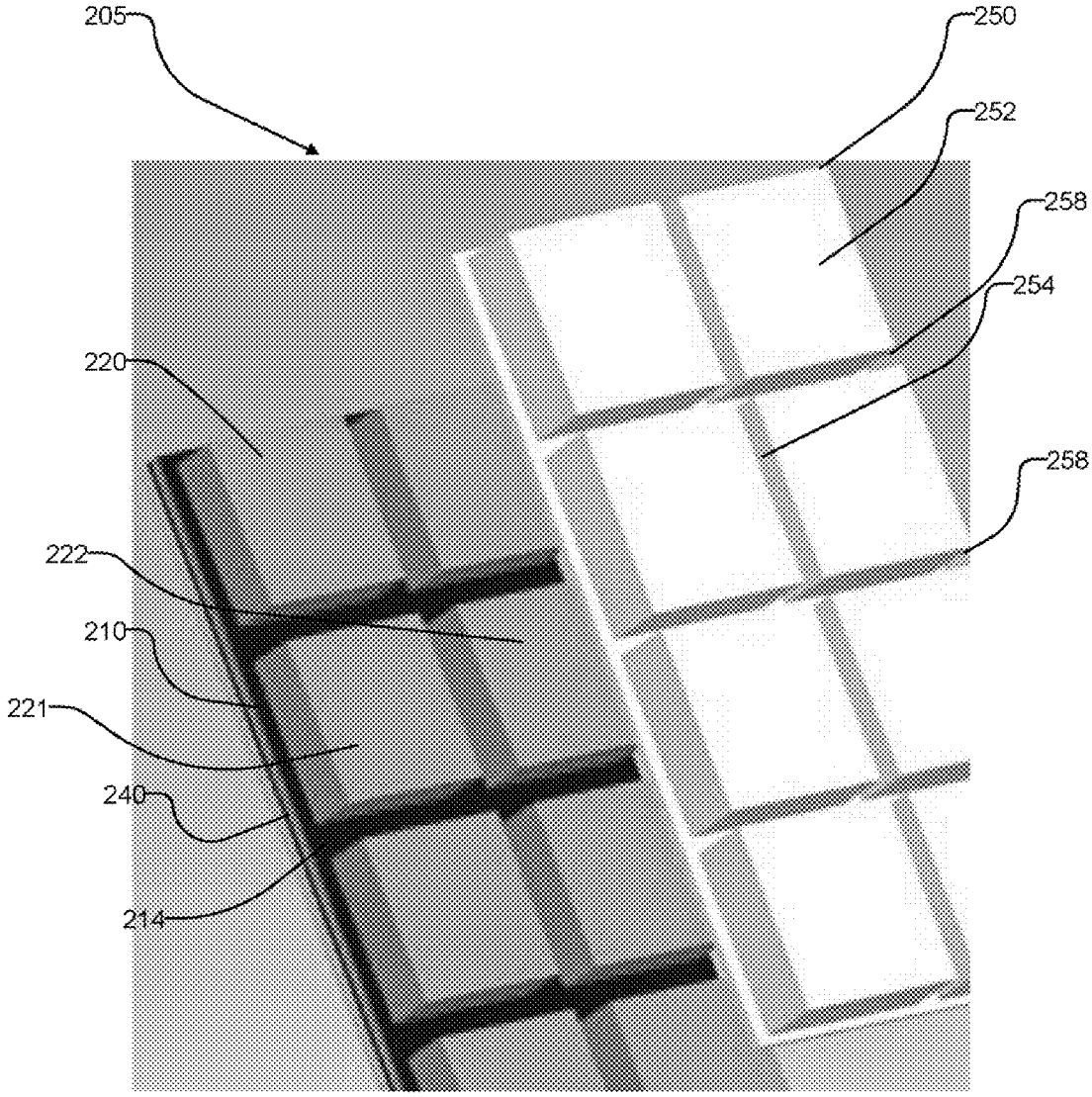
FIG. 3 is an exploded perspective view showing a subarray of a planar array antenna according to an embodiment.

Referring now to FIG. 3, a subarray 205 of a planar array antenna has a ground plane 210. The planar array antenna may be employed, by way of non-limiting example, as a phased array antenna for communications or radar. Ground plane 210 is a rigid, conductive, planar sheet, which may be of a metal, such as aluminum. Ground plane 210 has a rear face, not visible in FIG. 3, and a front face 214. Subarray 205 has radiating elements 220. Each radiating element 220 protrudes forward of the front face 214 of the ground plane 210. Each radiating element 220 is physically mounted to ground plane 210. Radiating elements 220 may be rigidly mounted directly or indirectly on ground plane 210, or mounted otherwise so as to protrude forward of front face 214 of ground plane 210. In the embodiment of FIG. 3, the radiating elements 220 are parasitic patch radiators, mounted on dielectric substrates. The radiating elements 220 may be excited from below the dielectric substrate by actively excited radiating elements, such as patches, waveguides or cavities. Circuit elements indicated generally at 240 are electrically coupled to the radiating elements, and physically mounted to the ground plane 210. Circuit elements 240 are positioned rearward of the rear face of the ground plane 210. Circuit elements 240 generally refer to passive transmission line circuit elements for receiving signals transmit/receive devices and distributing those signals to antenna elements, and for receiving signals from antenna elements and providing the received signals to transmit/receive devices, which in turn may transmit the signals to suitable electronics, such as beamformers. In the figures, multiple layers are shown to represent, for example, multi-layer circuit boards or other devices on which the circuit elements may be mounted and/or embedded.

Dielectric radome 250 is supported on the ground plane 210 when the subarray is fully assembled. Radome 250 defines a continuous surface sealed to ground plane 210. Radome 250 may be of an environmentally protective material, such as a fiber-impregnated resin, such as fiberglass. The term environmentally protective includes materials protective against any one or more of water, particulates, dust and other materials that may be present in the environment. The term environmentally protective may also include impact resistance. Radome 250 may be of a resin impregnated with other light, strong fibers such as the aramid fiber sold by E.I. du Pont de Nemours and Company, Wilmington, Del., USA, under the Keviar® trademark. Radome 250 is of a dielectric material, and is rigid or generally rigid. Radome 250 may be a unitary piece of material, and may be fabricated by molding. The continuous surface including a forward wall 252 positioned forward of each of radiating elements 220 to form an environmental seal surrounding the antenna radiating elements 220. An environmental seal includes a seal that is any one or more of waterproof, effective against other liquids, and effective to prevent the passage of particulate contaminants such as sand, dust, smoke particles and other airborne contaminants. In the embodiment of FIG. 3, forward wall 252 includes discrete wall segments aligned with each radiating element 220. The discrete wall segments may also be conformal to each radiating element 220. Radome 250 further has an intermediate wall 254 intermediate at least one pair of adjacent radiating elements 221, 222. In the embodiment of FIG. 3, radome 250 is formed toward the ground plane to form grooves 258 in a front face of the radome, the grooves defining the walls 254 intermediate each pair of adjacent ones of radiating elements 220. As used herein, adjacent elements are nearest neighbor elements in any direction.

Figure 4:
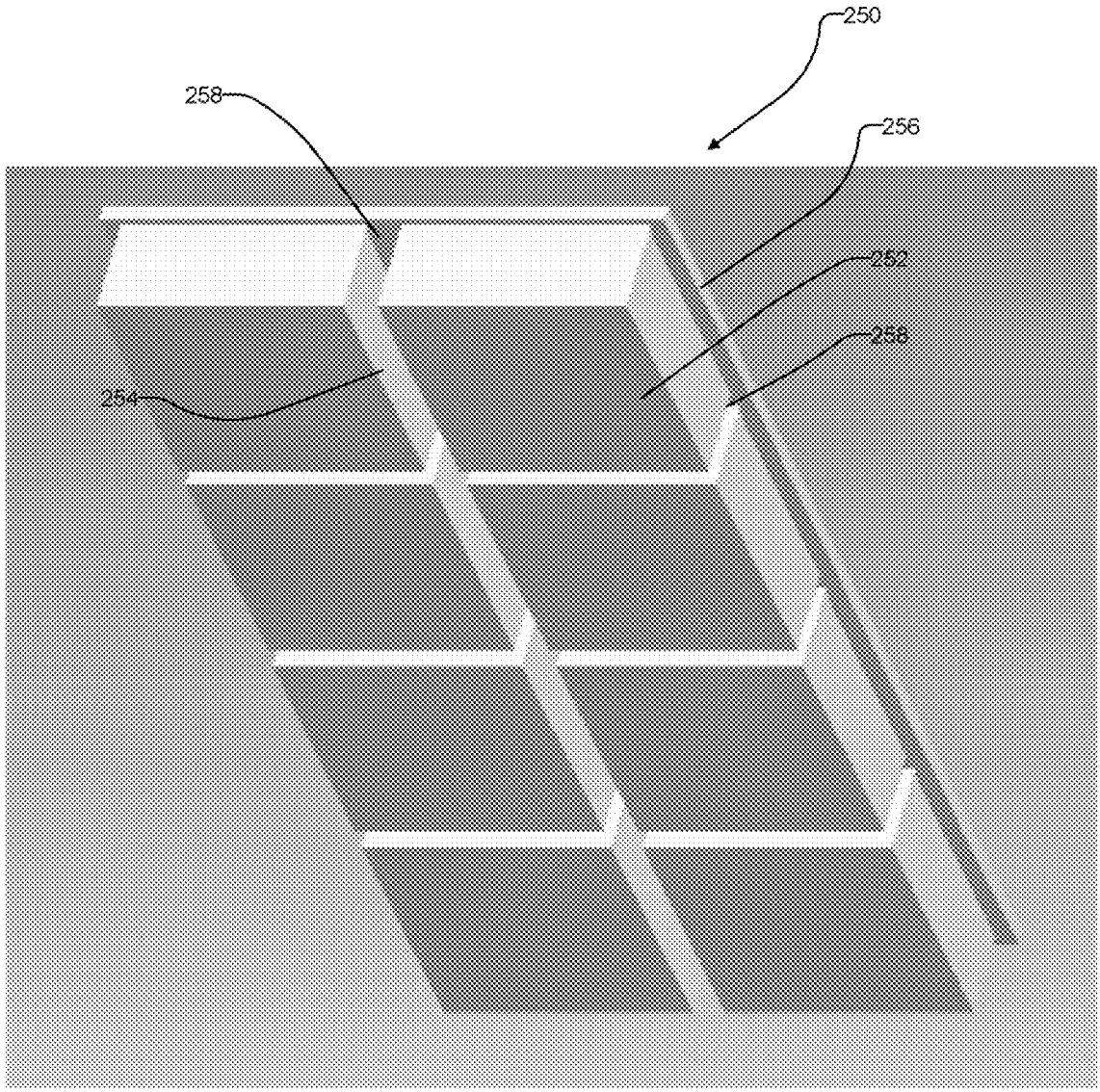
FIG. 4 is a perspective view of a radome of the subarray of FIG. 3.

Referring to FIG. 4, radome 250 is shown, with forward wall 252 and intermediate walls 254. Walls 254 may be provided between all adjacent pairs of antenna elements of the subarray, between substantially all adjacent pairs of antenna elements of the subarray, or between a majority of adjacent pairs of antenna elements of the subarray. Radome 250 has a radially extending lip 256. When radome 250 is mounted on the ground plane, radially extending lip 256 is adjacent ground plane 210. Radome 250, and in particular lip 256, may be sealed to ground plane 210 to form an environmental seal surrounding the antenna radiating elements. The environmental seal may be a watertight seal and may prevent the flow of other liquids and the passage of particulate contaminants. By way of non-limiting example, a polysulfide sealant may be employed to provide both adhesion and sealing. Radome 250, and in particular lip 256, may be sealed to ground plane 210 by a gasket and fasteners.

Figure 5:
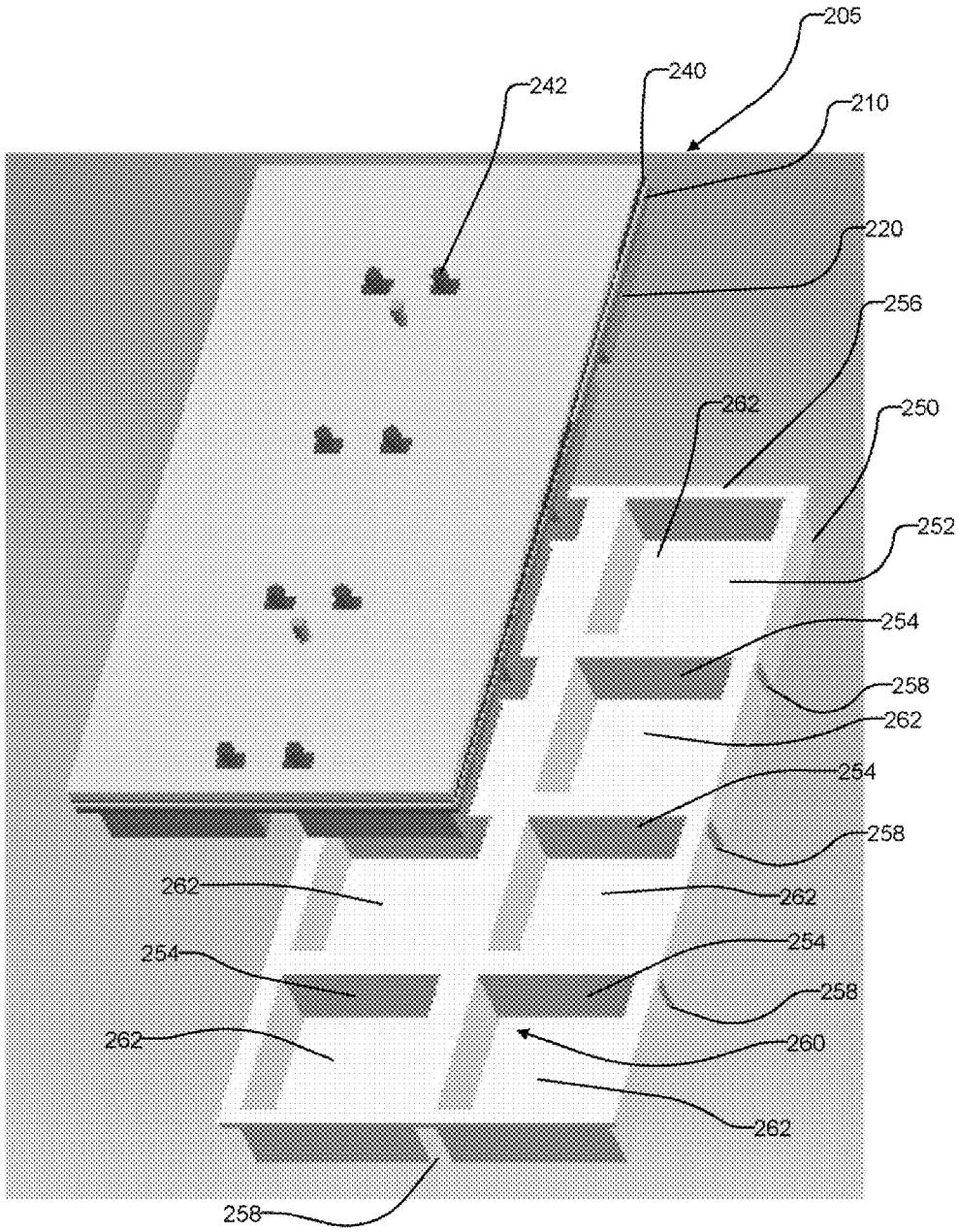
FIG. 5 is an isometric exploded view from the rear of the subarray of FIG. 3.

Referring to FIG. 5, an exploded isometric view of a subarray 205 is shown. Ground plane 210 has radiating elements 220 on a front face thereof. Circuit board 240 may include passive transmission line circuit elements such as RF power distribution networks, filters and couplers, which are electrically connected to radiating elements 220. Electrical connections 242 to connect circuit elements on circuit board 240 with transmit/receive devices (not shown) are provided. Radome 250 is shown exploded from ground plane 210. An interior surface of forward wall 252 is shown, along with intermediate walls 254. Radome 250 may be understood to have a central section 260 having alternating grooves 258 and pockets 262 shaped to receive the radiating elements and separate adjacent pairs of radiating elements, and continuous lip 256 circumscribing central section 260. Lip 256 lies in a plane for sealing to ground plane 210. Pockets 262 in the embodiment of FIGS. 3, 4 and 5 are generally square to conform to the shape of the radiating elements illustrated in this embodiment. Pockets 262 are shaped to receive radiating elements in the form of patch radiators. If the radiating elements have a different form, pockets 262 may have a different shape to receive the radiating elements. Pockets 262 may be shaped to conform to the shape of the radiating elements.

Figure 6:
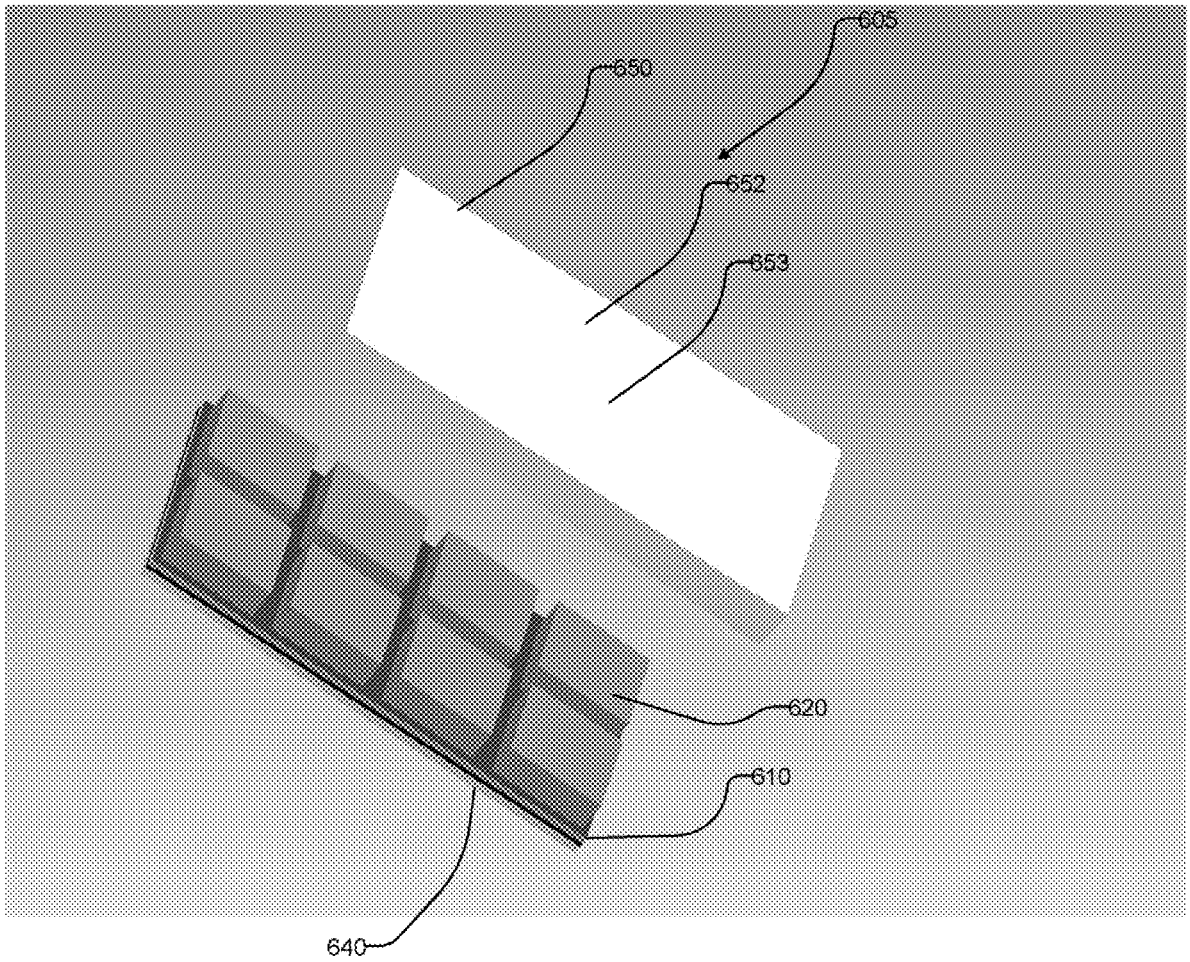
FIG. 6 is an exploded perspective view showing a subarray of a planar array according to an alternative embodiment.
Figure 7:
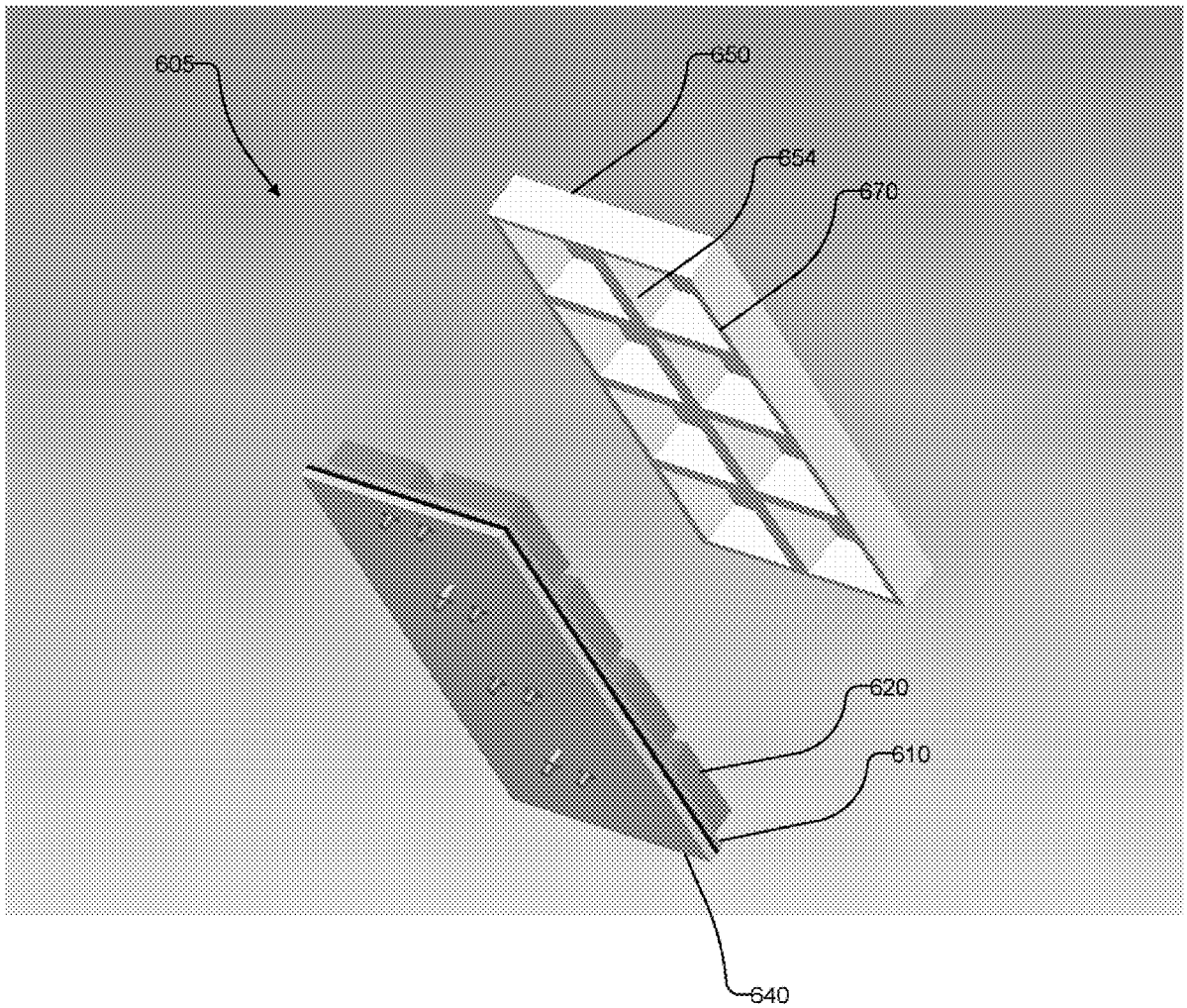
FIG. 7 is an exploded perspective view of the subarray of FIG. 6 from a different angle.

Referring now to FIGS. 6 and 7, an alternate embodiment of the subarray and radome will be described. Subarray 605 of a planar array antenna has a ground plane 610. Ground plane 610 is a conductive, planar sheet, which may be of a metal, such as aluminum. Ground plane 610 has a rear face and a front face. Subarray 605 has radiating elements 620. Each radiating element 620 protrudes forward of the front face of the ground plane 610. Each radiating element 620 is physically mounted to ground plane 610. Radiating elements 620 may be rigidly mounted directly or indirectly on ground plane 610. In the embodiment of FIGS. 6 and 7, the radiating elements 620 are patch radiators mounted on dielectric substrates. The patch radiators are merely exemplary radiating elements, and other radiating elements, such as stripline and microstrip dipoles, Vivaldi's, Helices and Monopoles. Circuit board 640 is electrically coupled to the radiating elements 620, and physically mounted to the ground plane 610. Circuit board 640 is positioned rearward of the rear face of the ground plane 610. Elements on circuit board 640 are electrically connected to transmit/receive devices (not shown).

Dielectric radome 650 is supported on the ground plane 610 when the subarray is fully assembled. Radome 650 defines a continuous surface sealed to ground plane 610. Radome 650 may be of environmentally resistant material, such as a fiber-impregnated resin, such as fiberglass. Radome 650 is of a dielectric material, and is rigid or generally rigid. The continuous surface including a forward wall 652 is positioned forward of each of radiating elements 620 to form an environmental seal surrounding the radiating elements 620. Radome 650 has a substantially planar front face 653. Intermediate walls 654 are defined by flanges depending rearward from front face 653. Intermediate walls 654 and the forward wall 652 may be conformal to the radiating elements 620. In an embodiment, intermediate walls 654 and forward wall 652 may be conformal to elements of alternative types, such as stripline and microstrip dipoles, Vivaldi's, Helices and Monopoles. A rim 670 on a rear outer edge of radome 650 lies in a plane. When subarray 605 is assembled, rim 670 may be bonded by adhesive or a gasket and fasteners to ground plane 610 to provide an environmental seal. Rim 670 therefore serves as a continuous surface sealed to ground plane 610. In an embodiment, a lip may be defined around radome 650. Radome 650 may be of molded fiberglass, or other fiber-impregnated resin.

Figure 8A:
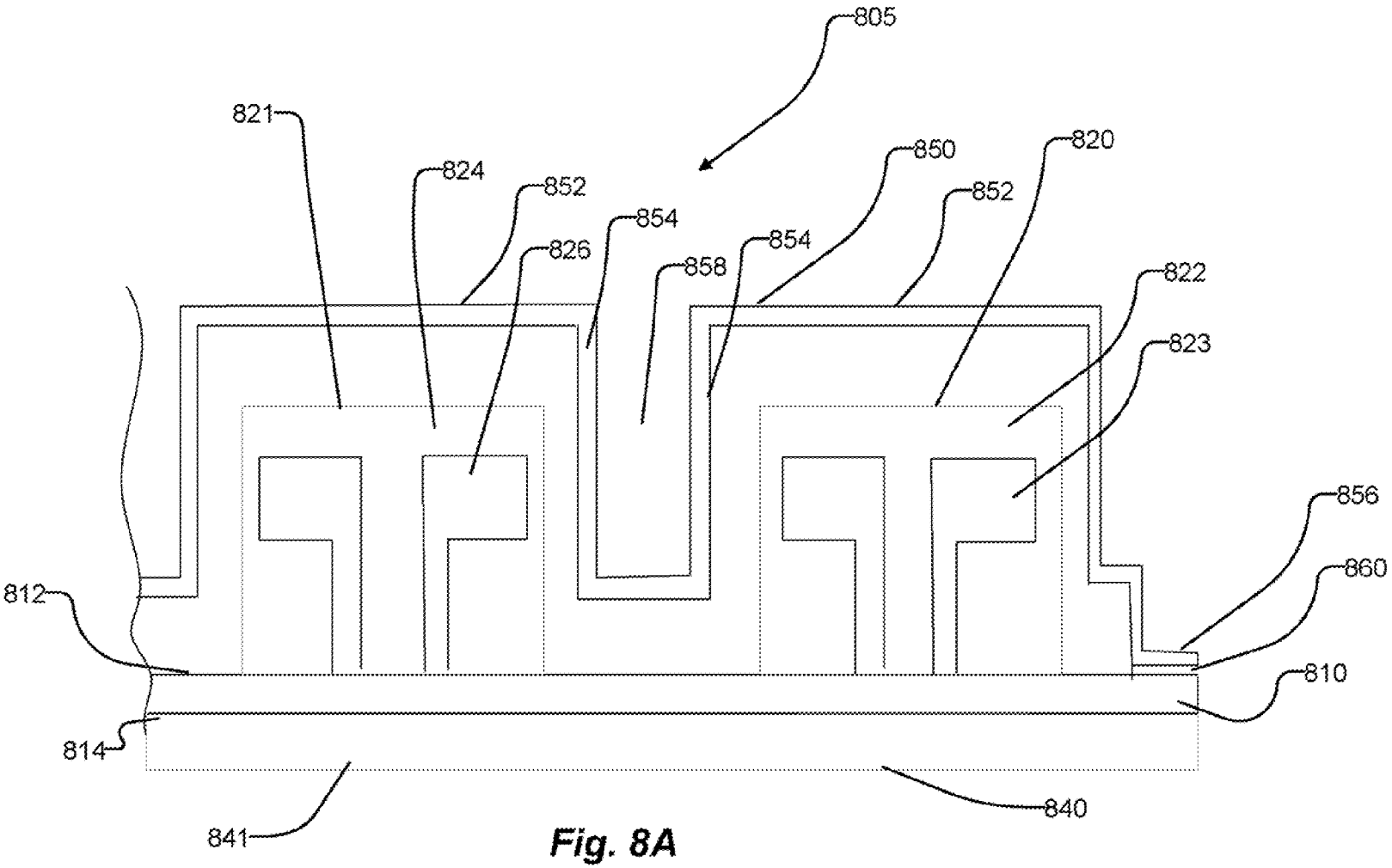
FIG. 8A is a partial cross-section view of an embodiment of a subarray having dipole radiating elements implemented in stripline protruding from a ground plane.

Referring now to FIG. 8A, a partial cross-sectional view is provided of a subarray in accordance with an embodiment of the invention employing dipole antenna elements, and particularly dipoles implemented in stripline. In the embodiment of FIG. 8A, the radome 850 does not reach to ground plane 810 intermediate antenna elements 820, 821. Subarray 805 includes ground plane 810. Dipole antenna elements 820, 821, of the stripline type, protrude forward of a front face 812 of ground plane 810. Transmit-receive devices 840, 841 are physically mounted to a rear face 814 of ground plane 810 and are in electrical communication, via transmission lines (not shown) through ground plane 810 with respective antenna elements 820, 821. Element 820 has a dielectric substrate 822 with metallization 823 to provide a dipole antenna element. Similarly, element 821 has a dielectric substrate 824 with metallization 826 to provide a dipole antenna element. Radome 850 defines a continuous surface forward of antenna elements 820, 821. Radome 850 has a forward wall 852 forward of antenna elements 820, 821. Intermediate walls 854 are provided intermediate pair of adjacent antenna elements 820, 821. Intermediate walls 854 are separated by a groove 858. In the illustrated embodiment, intermediate walls 854 do not reach ground plane 810; however, in an embodiment, intermediate walls may reach ground plane 810. Lip 856 lies in a plane and is sealed to ground plane 810 by sealant 860.

Figure 8B:
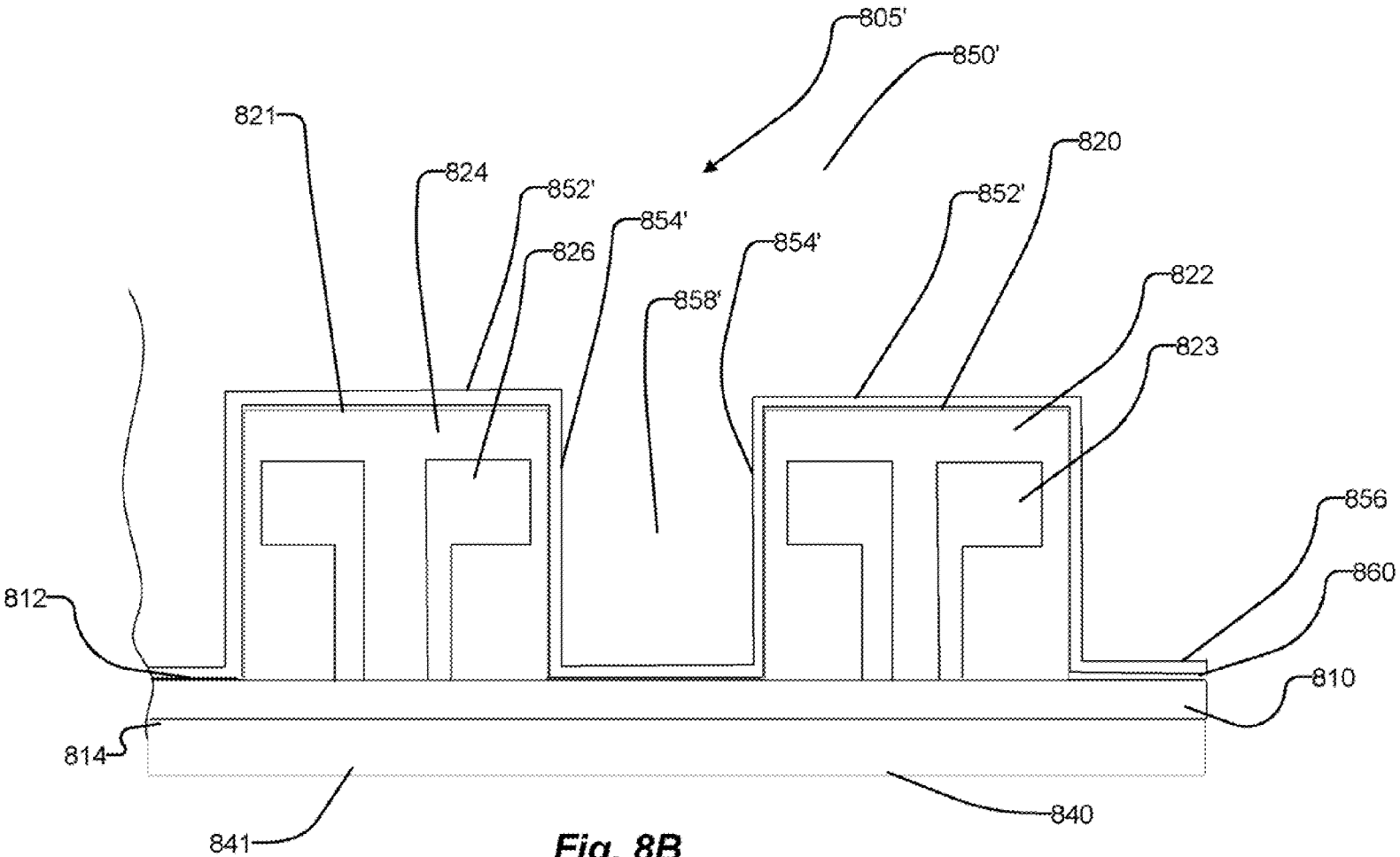
FIG. 8B is a partial cross-section of an embodiment of a subarray having dipole radiating elements implemented in stripline and a radome closely conforming to the elements.

Referring now to FIG. 8B, a partial cross-sectional view of a subarray 805' in accordance with an embodiment is provided. Subarray 805' of FIG. 8B differs from subarray 805 of FIG. 8A in that radome 850', and particularly intermediate walls 854', of subarray 805' is in contact with ground plane 810 intermediate elements 820, 821. It will be understood that grooves 858' are also in contact with ground plane 810. Radome 850' also conforms closely to elements 820, 821. Radome 850' may be in contact with elements 820, 821. One of ordinary skill in the art may select a separation between radome 850' and elements 820, 821. In an embodiment, the separation may be not greater than a small percentage of a wavelength at an operating frequency of the antenna, or within a range of expected operating frequencies of the antenna, of which subarray 805' is a part. In embodiments, the small percentage of the wavelength may be any one of 2%, 5%, 10% and 15%.

Figure 9:
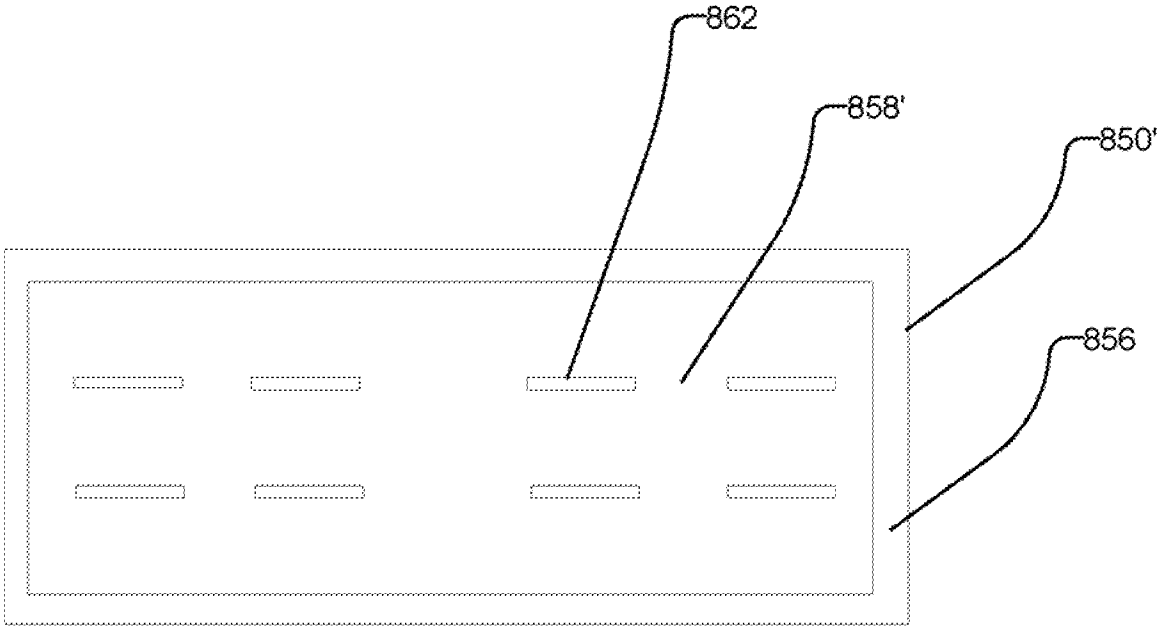
FIG. 9 is a top plan view of the subarray of FIG. 8B.

Referring now to FIG. 9, a top plan view of radome 850' of FIG. 8B is shown. Radome 850' has pockets 862 having a shape selected to conform closely to the form of the stripline dipole antennas. Pockets 862 have an elongated rectangular shape in this embodiment. Pockets 862 are separated by grooves 858'. Lip 856 lies in a plane for adhesion and sealing to a ground plane.

Figure 10:
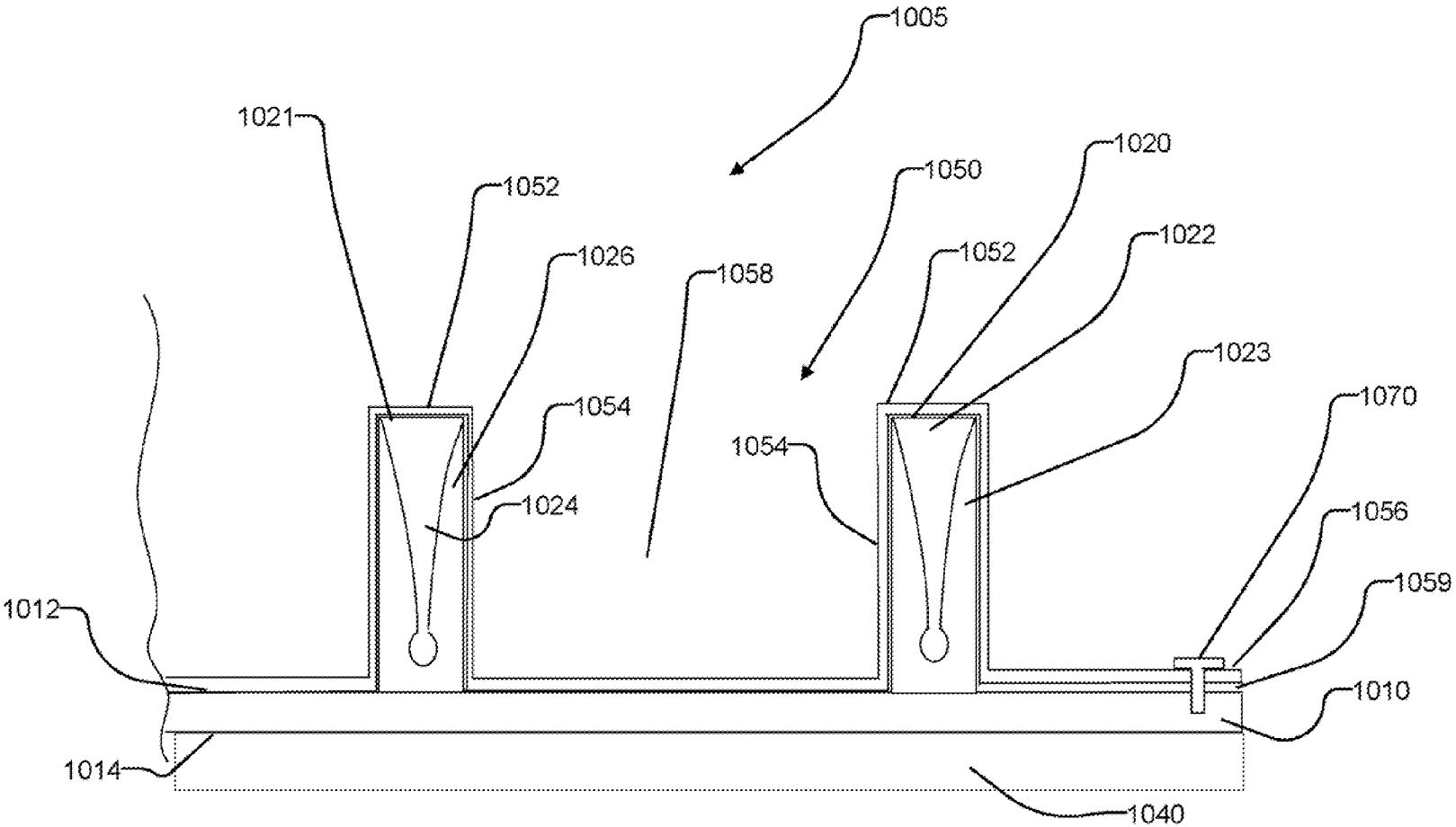
FIG. 10 is a partial cross-section view of a subarray according to an embodiment having Vivaldi elements.

Referring now to FIG. 10, a partial cross-sectional view is provided of a subarray in accordance with an embodiment of the invention employing Vivaldi antenna elements, and particularly Vivaldi elements implemented in stripline. Subarray 1005 includes ground plane 1010. Vivaldi antenna elements 1020, 1021 protrude forward of a front face 1012 of ground plane 1010. Circuit board 1040 includes circuit elements and is physically mounted to a rear face 1014 of ground plane 1010; the circuit elements are in electrical communication, via transmission lines (not shown) through ground plane 1010 with respective antenna elements 1020, 1021. Element 1020 has a dielectric substrate 1022 with metallization 1023 to provide a Vivaldi antenna element. Similarly, element 1021 has a dielectric substrate 1024 with metallization 1026 to provide a Vivaldi antenna element. Radome 1050 defines a continuous surface forward of antenna elements 1020, 1021. Radome 1050 has a forward wall 1052 forward of antenna elements 1020, 1021. Intermediate walls 1054 are provided intermediate pair of adjacent antenna elements 1020, 1021. Intermediate walls 1054 are separated by a groove 1058. In the illustrated embodiment, intermediate walls 1054 reach ground plane 1010 and are closely conformal to antenna elements 1020, 1021; forward wall 1052 is also closely conformal to antenna elements 1020, 1021. However, in an embodiment, intermediate walls may not reach ground plane 1010, and greater separation may be provided between the intermediate walls and the forward wall and the antenna elements. Lip 1056 lies in a plane and is sealed to ground plane 1010 by gasket 1059 and fasteners 1070, which may be screws, bolts or other fasteners of metal or of a dielectric material. In an embodiment, a sealant may seal ground plane 1010 to lip 1056, and gasket 1059 and fasteners 1070 may be omitted.

Figure 11:
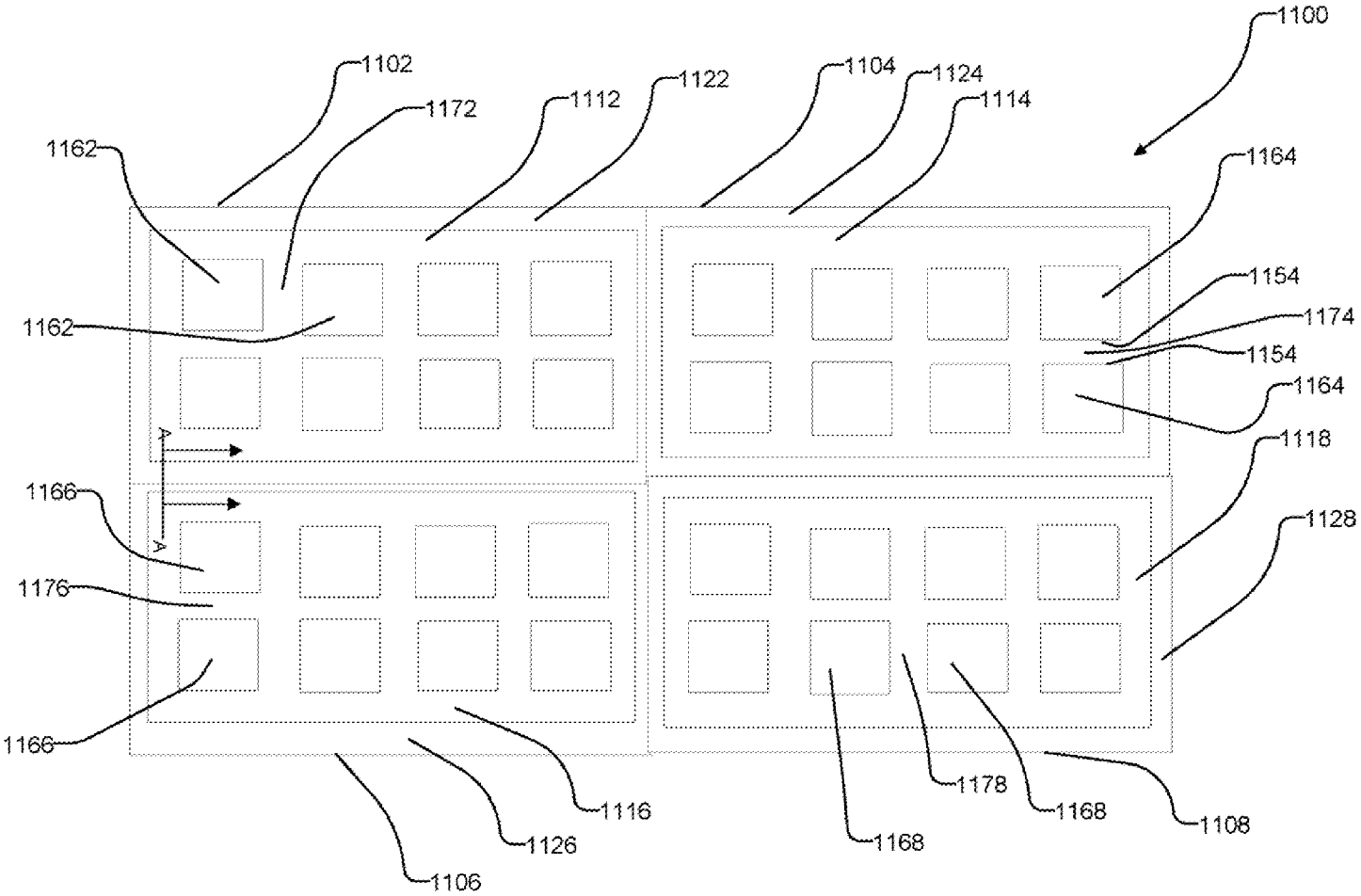
FIG. 11 is a top plan view of an antenna array.

Referring now to FIG. 11, a planar array antenna 1100 is shown in a top plan view. Planar array antenna 1100 has adjacent subarrays 1102, 1104, 1106, 1108. While four subarrays each having eight radiating elements are shown, a larger or smaller number of subarrays may be employed. Each subarray may have any number of radiating elements. Each subarray 1102, 1104, 1106, 1108, may be the same as the subarrays illustrated in FIG. 3, FIG. 8A, FIG. 8B or FIG. 10. Each subarray 1102, 1104, 1106, 1108 has components, not shown in FIG. 11, including a ground plane having a rear face and a front face; antenna elements, each extending forward of the front face of the ground plane and physically mounted to the ground plane; transmit-receive devices electrically coupled to the antenna elements and physically mounted to the ground plane and positioned rearward of the rear face of the ground plane; and a dielectric radome 1112, 1114, 1116, 1118 supported on the ground plane having a continuous surface sealed to the ground plane and positioned forward of each of the antenna elements to form an environmental seal surrounding the antenna elements. Each dielectric radome 1112, 1114, 1116, 1118 has a wall 1154 positioned intermediate at least one pair of adjacent ones of the antenna elements. In the illustrated embodiment, walls 1154 are provided intermediate each pair of adjacent ones of the antenna elements. Each dielectric radome 1112, 1114, 1116, 1118 has a radially extending lip 1122, 1124, 1126, 1128 adjacent the ground plane and overlapping the lip of the radome of the adjacent subarray. The continuous surface of the dielectric radomes 1112, 1114, 1116, 1118 is curved or recessed, in a central section circumscribed by the lips, to define pockets, 1162, 1164, 1166, 1168, separated by grooves 1172, 1174, 1176, 1178. The central section has alternating grooves and pockets. The pockets are shaped to receive the radiating elements and separate adjacent pairs of radiating elements by walls 1154. The form of the radomes may also be understood as grooves 1172, 1174, 1176, 1178 defining walls 1154 intermediate each pair of adjacent ones of the radiating elements within each of the subarrays.

Figure 12:
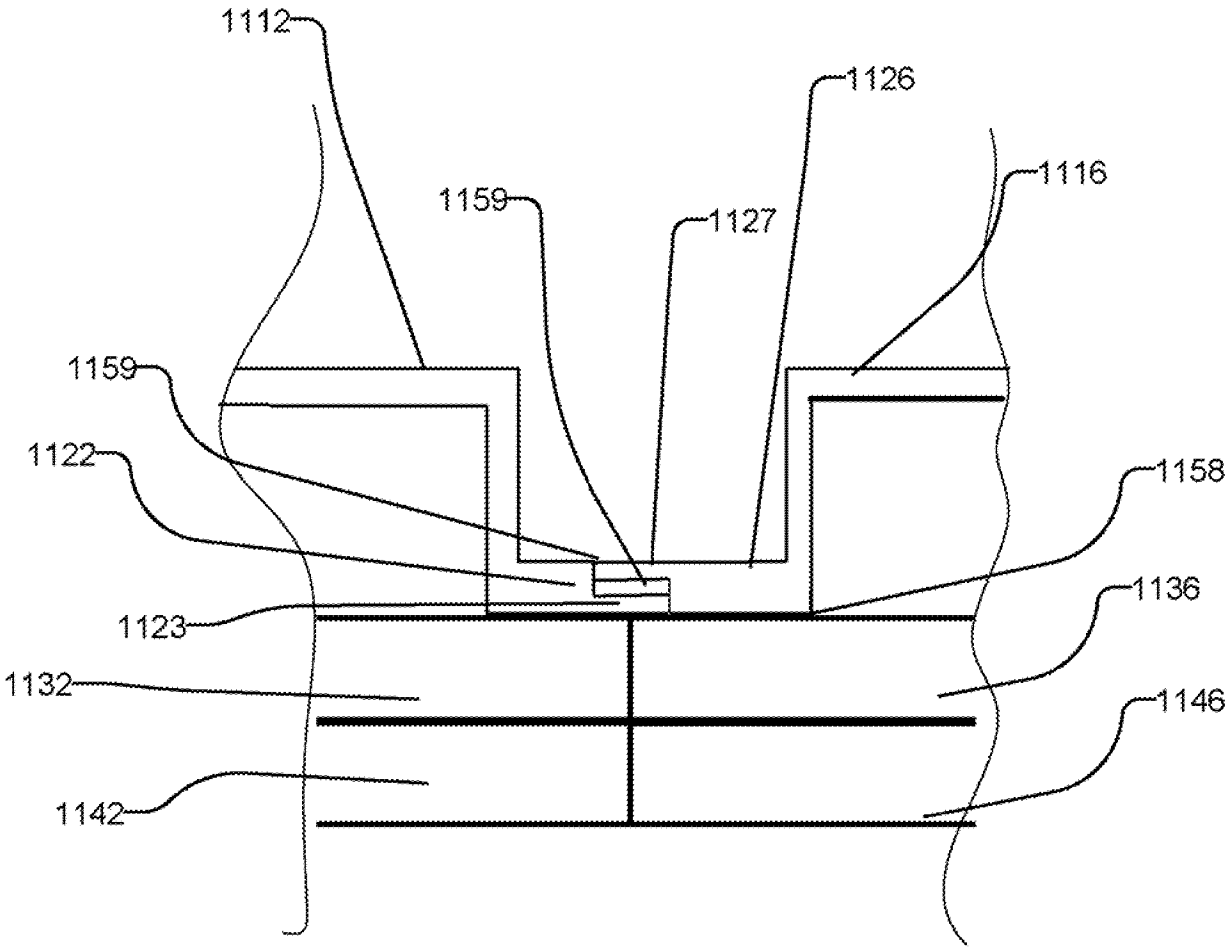
FIG. 12 is a partial cross-section view of the array of FIG. 11, taken along line A-A.

Referring to FIG. 12, a partial cross-section view of the array of FIG. 11, taken along line A-A, is shown. Ground planes 1132, 1136 and boards 1142, 1146, on which transmit-receive devices are mounted, are shown abutting one another. Radomes 1112, 1116 have respective radially extending lips 1122, 1126, which are adjacent respective ground planes 1132, 1136. Lip 1126 has a circumferential joint portion 1127 of reduced thickness that overlaps circumferential a joint portion 1123 of reduced thickness of lip 1122. The combined thicknesses of joint portions 1123 and 1127 may be less than the thickness of either of lip 1126 or lip 1122. Lips 1122, 1126 may have the same thickness. Sealant 1158 seals lips 1122, 1126 to ground planes 1132, 1136. Sealant is also provided at 1159 intermediate joint portions 1123, 1127 to seal lip 1122 to lip 1126. The thickness of the joint made up of mitered joint portions 1123, 1127 and sealant 1159 is the same as the thickness of joints 1122, 1126, so as to provide a uniform thickness of dielectric across an interface of the adjacent radomes. By providing a constant thickness at the subarray interface, periodic structures are avoided. The sealant 1159 also serves as an adhesive. In another embodiment, a gasket may be provided in place of or in addition to the sealant at 1159, and fasteners provided through lip 1126, the gasket, lip 1122, a sealant or gasket below lip 1122, and into one of the ground planes 1132, 1136, to provide sealing against water, particles and other liquid and particulate contaminants.

In the embodiments of subarrays and arrays illustrated and discussed above, the radome is connected to the ground plane by sealant, a gasket and fasteners, or a combination of sealants and gaskets and fasteners. No struts, standoffs or other parts support the radome or connect the radome to the ground plane.

Figure 13:
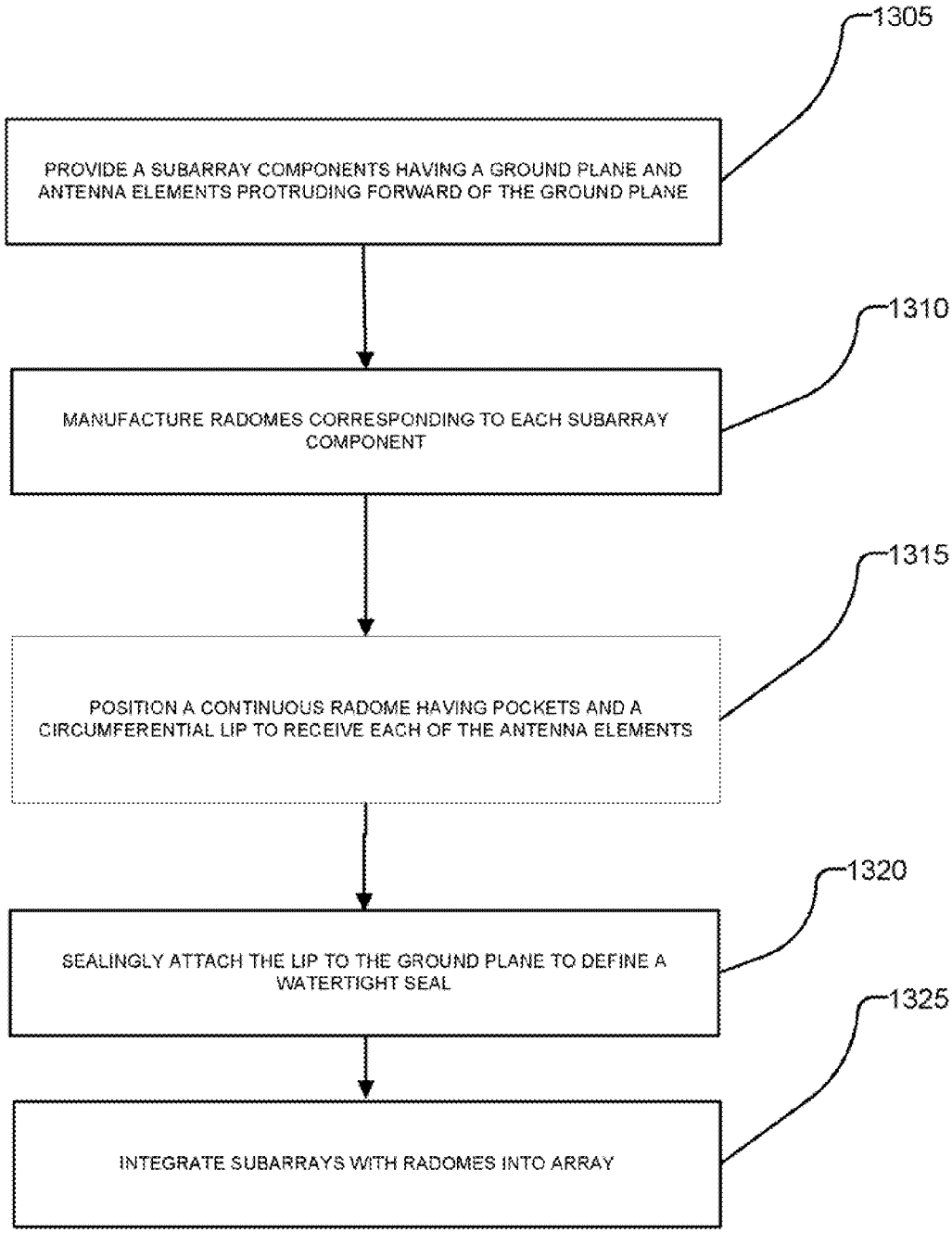
FIG. 13 is a process flow diagram of a method of manufacturing a subarray for a planar array antenna.

Referring now to FIG. 13, a method of manufacturing a planar array antenna includes providing 1305 subarray components, each subarray component having: a ground plane having a rear face and a front face; radiating elements, each of which radiating elements protrudes forward of the front face of the ground plane and is physically mounted to the ground plane; and transmit-receive devices electrically coupled to the radiating elements, and physically mounted to the ground plane and positioned rearward of the rear face of the ground plane. Radome components are manufactured 1310 corresponding to each subarray component. Each radome component may be a single-piece layup in a fiber-impregnated resin, such as fiberglass, and may be manufactured in a mold employing vacuum-form manufacturing techniques. Each radome component may be continuous, environmentally protective and rigid. Each radome component may have a central section having alternating grooves and pockets shaped to receive the radiating elements and to separate adjacent pairs of radiating elements; and a continuous lip, circumscribing the central section. The lip may lie in a plane for sealing to the ground plane. Each radome component may be positioned 1315 on each subarray component so as to receive each of the radiating elements. Each radome component may be sealingly attached 1320 to the ground plane to define an environmentally protective seal. The attaching step may be applied by providing a watertight adhesive sealant, such as a polysulfide, or by providing a gasket with fasteners. Each subarray with its radome component may be integrated 1325 into the planar array antenna. The lip of each radome component may include a circumferential thinner portion, which may have a mitered appearance, to facilitate positioning of lips of adjacent radome components to overlap, with intermediate sealant or a gasket, while providing a uniform thickness of dielectric material. The step of integrating the subarrays may include positioning the radomes so that the thinner circumferential portions of lips of adjacent radomes overlap and sealing the lips of adjacent radomes to provide a uniform thickness of dielectric across the interface of the adjacent radomes.

Exemplary advantages of a device and method in accordance with an embodiment of the present invention include the following. Individual radomes may be removed to provide access to individual subarrays from the front of an array antenna for repair and replacement. As the individual radomes may be of molded fiberglass, for example, a radome according to an embodiment may be smaller and lighter than A-sandwich radomes of the prior art, and accordingly the personnel time required for removal and replacement of the radome is reduced. Similarly, as access to elements, circuits, devices and other components from the front of the array requires removal and replacement of the radome, the personnel time for activities involving access to any such component is reduced. The dielectric loading resulting from the radome material intermediate adjacent elements may reduce the physical size required of a radiating element for resonance at a given operating frequency. The electrical distance between elements is increased by the radome material intermediate adjacent elements, thereby reducing mutual coupling between elements and reducing the excursion of element input impedance as a function of operating frequency and scan angle for a scanning phase array. If a sealant such as polysulfide is employed for adhesion and sealing of the radome to the ground plane, a knife or similar tool with a sharp flat blade may be employed to remove the radome by cuffing through the sealant, thereby reducing personnel time compared to the personnel time required to remove screws. The overlapping radomes of the embodiment of FIGS. 11 and 12, for example, avoid the problem of grating lobes resulting from radiating dielectric discontinuities. Radomes may be sealed to each subarray at the time of manufacture and assembly of the subarray, thereby simplifying the integration of the radome into the array.

Applications of radomes, subarrays, arrays and methods disclosed herein include in phased array antennas for use in radar and communications, for example.

While the foregoing invention has been described with reference to the above-described embodiment, various modifications and changes can be made without departing from the spirit of the invention. Accordingly, all such modifications and changes are considered to be within the scope of the appended claims.

What is claimed is:

1. A subarray for a planar array antenna, comprising:
a ground plane having a rear face and a front face;
a plurality of radiating elements, each of said radiating elements protruding forward of the front face of the ground plane and physically mounted to the ground plane;
a plurality of circuit elements electrically coupled to the radiating elements, and physically mounted to the ground plane and positioned rearward of the rear face of the ground plane;
a dielectric radome supported on the ground plane defining a continuous surface sealed to the ground plane, the continuous surface including a forward wall positioned forward of each of said radiating elements to form an environmental seal surrounding the radiating elements, wherein said radome is recessed toward the ground plane to form external grooves in a front face of the radome, the external grooves defining an intermediate dielectric wall intermediate at least one pair of adjacent ones of said radiating elements.

2. The subarray of claim 1, wherein the radome is environmentally protective.

3. The subarray of claim 1, wherein the radome is adhesively sealed to the ground plane.

4. The subarray of claim 1, wherein the radome is sealed to the ground plane by a gasket and a plurality of fasteners.

5. The subarray of claim 1, wherein the radome has walls intermediate each pair of adjacent ones of said radiating elements.

6. The subarray of claim 1, wherein the grooves contact the ground plane.

7. The subarray of claim 5, wherein the radome has a substantially planar front face, said walls being defined by flanges depending rearward from said front face of the radome.

8. The subarray of claim 1, wherein the intermediate walls are conformal to the elements, and the radome contacts the ground plane intermediate the elements.

9. The subarray of claim 1, wherein the radome has walls intermediate a majority of pairs of adjacent ones of the radiating elements.

10. The subarray of claim 1, wherein the radome has walls intermediate substantially all pairs of adjacent ones of the radiating elements.

11. The subarray of claim 1, wherein the radiating elements are patch antenna elements.

12. The subarray of claim 1, wherein the radiating elements are dipole elements.

13. The subarray of claim 1, wherein the radiating elements are Vivaldi's.

14. The subarray of claim 1, wherein said radome is of a fiber-impregnated resin.

15. The subarray of claim 14, wherein the fiber-impregnated resin is fiberglass.

16. A planar array antenna, comprising:
a plurality of adjacent subarrays;
each of said subarrays comprising:
a ground plane having a rear face and a front face;
a plurality of antenna elements, each extending forward of the front face of the ground plane and physically mounted to the ground plane;
a plurality of circuit elements electrically coupled to the antenna elements and physically mounted to the ground plane and positioned rearward of the rear face of the ground plane; and
a dielectric radome supported on the ground plane having a continuous surface sealed to the ground plane and positioned forward of each of said antenna elements to form an environmental seal surrounding the antenna elements and having a wall positioned intermediate at least one pair of adjacent ones of said antenna elements;
each of said radomes having a radially extending lip adjacent the ground plane and overlapping a radially extending lip of the radome of the adjacent subarray.

17. The antenna of claim 16, wherein said overlapping lips are adhesively sealed to one another.

18. The antenna of claim 16, wherein each of said radomes is curved toward the ground plane of its subarray to form grooves in a front face of the radome, the grooves defining walls intermediate each pair of adjacent ones of said radiating elements within each of said subarrays.

19. A radome for a subarray of a planar array antenna, the subarray having a plurality of radiating elements protruding forward of a ground plane, the radome comprising:
a continuous, environmentally-protective, rigid dielectric thin member, having:
a central section having alternating external grooves and internal pockets shaped to receive the radiating elements and separate adjacent pairs of radiating elements; and
a continuous lip, circumscribing and extending radially outward from said central section, said continuous lip lying in a plane parallel to the ground plane for sealing to the ground plane.

20. The radome of claim 19, wherein the radome is of molded fiberglass.

21. The radome of claim 19, wherein the lip comprises a circumferential joint portion of reduced thickness.

22. A method of manufacturing a planar array antenna, comprising;
providing a plurality of subarray components, each of said subarray components having:
a ground plane having a rear face and a front face;
a plurality of radiating elements, each of said radiating elements protruding forward of the front face of the ground plane and physically mounted to the ground plane;
a plurality of circuit elements electrically coupled to the radiating elements, and physically mounted to the ground plane and positioned rearward of the rear face of the ground plane;
positioning on each of said subarray components, so as to receive each of the radiating elements, a continuous, waterproof, rigid dielectric radome having:
a central section having alternating external grooves and internal pockets shaped to receive the radiating elements and separate adjacent pairs of radiating elements; and
a continuous lip, circumscribing said central section, said lip lying in a plane for sealing to the ground plane;

attaching each of the positioned radomes to the ground plane at least at the lip of the radome to define a plurality of subarrays; and integrating the subarrays into an array, the integrating comprising joining the lips of adjacent ones of said radomes.

23. The method of claim 22, wherein the attaching each of the positioned radomes to the ground plane comprises employing an adhesive.

24. The method of claim 22, wherein the joining the lips of adjacent ones of said radomes comprises overlapping and sealing reduced thickness circumferential portions of the lips to provide a uniform thickness of dielectric across an interface of the adjacent ones of the radomes.

* * * * *